United States Patent [19]

Koch, deceased

[11] 4,404,830

[45] Sep. 20, 1983

[54] METHOD AND APPARATUS FOR PRESSING PARTS FROM ROUND STOCK

[75] Inventor: Friedrich-Karl Koch, deceased, late of Krefeld, Fed. Rep. of Germany, by Annekathrin Koch, Klaus-Michael Koch, executors

[73] Assignee: L. Schuler GmbH, Goppingen, Fed. Rep. of Germany

[21] Appl. No.: 362,503

[22] Filed: Mar. 26, 1982

Related U.S. Application Data

[63] Continuation-in-part of Ser. No. 649,417, Jan. 15, 1976, abandoned.

[30] Foreign Application Priority Data

Jan. 16, 1975 [DE] Fed. Rep. of Germany ..... 2501506

[51] Int. Cl.[3] ..... B21B 37/04

[52] U.S. Cl. ..... 72/128; 72/337; 72/339; 226/156

[58] Field of Search ..... 72/361, 337, 339, 422, 72/128, 253; 226/142, 156, 134, 136, 364, 342, 419, 425, 3, 4; 10/25, 11 T

[56] References Cited

U.S. PATENT DOCUMENTS

| | | | |
|---|---|---|---|
| 2,326,106 | 8/1943 | Van Ness et al. | 72/337 |
| 2,355,468 | 8/1944 | Robb | 72/342 |
| 2,400,866 | 5/1946 | Kronwall | 72/364 |
| 2,538,619 | 1/1951 | Friedman | 72/425 X |
| 2,767,836 | 10/1956 | Nachtman et al. | 72/364 X |
| 2,870,920 | 1/1959 | Granström et al. | 72/419 X |
| 2,897,697 | 8/1959 | Smith | 72/364 X |
| 3,094,160 | 6/1963 | Walton et al. | 72/364 X |
| 3,257,835 | 6/1966 | Cofer et al. | 72/364 |
| 3,698,219 | 10/1972 | Moore et al. | 72/342 |
| 3,783,669 | 1/1974 | Furney, Jr. | 72/342 |

*Primary Examiner*—Horace M. Culver

*Attorney, Agent, or Firm*—Shlesinger, Arkwright, Garvey & Fado

[57] ABSTRACT

A method and apparatus for producing pressed parts from round stock such as steel wire wound on a reel, which comprises unwinding the wire from the reel, passing the wire through a straightening device, and then feeding the wire intermittently through a heater where it is heated to a temperature of between 600° C. and 850° C. and subsequently cut to the appropriate length and fed to a press where it is pressed to the appropriate shape.

4 Claims, 5 Drawing Figures

METHOD AND APPARATUS FOR PRESSING PARTS FROM ROUND STOCK

CROSS REFERENCE TO RELATED APPLICATION

This application is a continuation-in-part of abandoned U.S. patent application Ser. No. 649,417 filed Jan. 15, 1976.

This invention relates to a method and apparatus for the production of parts pressed from round stock, particularly a steel wire wound to a lashing, in a reshaping press wherein the round material is introduced with intermittent movement into the reshaping process, wherein it is cut to length, conveyed to the die, and reshaped in at least one pressing stage to a finished part. The apparatus also comprises at least one feeding device and a reshaping press wherein the reshaping press has a shearing station containing a conveying device for conveying the sheared round stock to the die.

Generally similar methods and apparatus have been used in the past for cold pressing of parts. However, cold pressing is disadvantageous in that the reshaping force or reshaping energy is relatively great in such a cold pressing process. This disadvantage, however, can be avoided if the part to be formed is heated to a forging temperature, typically a temperature in the range of 850° to 1200° C. At such temperature, however, there is a risk of scale formation, and the accuracy-to-measure of forged pressed parts is less, and considerable thermal energy is required.

The present invention, therefor, seeks to overcome the disadvantages of cold pressing and hot forging by providing a method and apparatus which combines the advantages of both cold pressing and hot forging, particularly in using steel wire material.

The problem is solved according to the present invention in that the round wire stock, before it is cut to length, is heated to a temperature in the so called "half-warm" or "semi-warm" range. This temperature is between 600° C. and 850° C., within which range lies the $Ac_1$ transformation point for steels suitable according to the present invention, such as, for example, eutectoid steel. The advantage of this method is that the reshaping energy is considerably reduced, with respect to cold pressing, while good accuracy may be achieved without the risk of scale formation. The physical properties of the parts produced are quite good in relation to hot forged parts produced according to the prior techniques. The method also permits the use of wire lashing wound on a roll as a starting material.

Another feature of the method and apparatus according to the present invention is that after the stock has been heated to the temperature as discussed, it is subjected to tensile stresses which can affect the operation, and the only force exerted on the work is the shearing at the shear station and the shaping in the press dies.

Preferably, the temperature of the stock is maintained within the half-warm range after heating until it cut off. In this way, cooling during the period between heating and pressing is substantially avoided. To further minimize the cooling, preferably the die or dies in the press are maintained at a constant temperature of about 150° C. In this manner, heat transfer from the round stock to the press may be kept low so that the temperature of the work does not drop to undesirable levels during the residence time in the die. This is of particular advantage during start up of the machine, for example at the beginning of a shift since the operating temperature of the tools would only be attained after a certain operating time without such heating. With the heating of the dies, however, the pressed parts as obtained at the start of the production show good accuracy-to-measure which is comparable to that obtained in cold pressing.

According to another feature of the invention, a wire wound on a lashing is used as the round stock, and the wire is unrolled and then straightened prior to heating. The apparatus for carrying out the method is characterized according to the present invention in that an inductance heater for the round stock is positioned between the feeding device and the reshaping press. The inductance heater heats the stock to the desired half-warm temperature in a continuous heating fashion.

If wire is used as the starting material, a straightening device may be arranged ahead of the feeding station according to the invention, and ahead of the straightening device is a drive mechanism. The drive mechanism serves as an auxiliary device for introducing the wire to the feed rollers of the feeding device, which then introduces the wire into the machine. Particularly if wire is used, it is necessary to arrange the inductance heater behind the feeding device as seen in the direction of motion of the wire, since significant forces are required to overcome the winding stress and the straightening forces in the straightening device which, if the feeding device acted on the heated wire, would unduly deform the wire. For this reason, the feeding force must act on the wire which has not yet been heated.

Preferably, the inductance heater has a temperature regulating device for maintaining the temperature of the steel wire stock constant as it passes through the inductance heater.

Furthermore, it is preferred to provide a holding furnace in the path between the inductance heater and the shearing station in order to prevent a undesired temperature drop of the wire stock. In addition, it is possible within the scope of the invention that the inductance heater and the holding furnace may be disconnected or turned off during the operation of the apparatus in such a way that the finished parts may be produced in the same apparatus both by cold-pressing as well as by pressing within the half-warm range.

According to another feature of the invention, the intermittently operating feeding device is connected over a feeding control device with the drive shaft for the press carriage of the reshaping press. To this end, the feeding control device may have a double cam plate arranged on the drive shaft, which is so designed that it sets a fixedly mounted two-arm lever with a tap roller for a cam plate into a swivel motion during the rotation of the drive shaft, and that one arm of the two arm lever is connected with a coupling rod which is in turn connected to the feeding device through additional levers. In this manner, the round stock to be pressed is drawn by a certain, predetermined amount into the reshaping press with each stroke of the press carriage.

Since the thermal stress of the pressing tools is relatively high in half-warm forming, compared to cold forming, while the life of these tools depends to a considerable extent on this thermal stress, it may be necessary for economical reasons to increase the cooling time of the tools, compared to the heat contact time between the round stock to be pressed and the tools. This can be effected according to another feature of the invention in such a way that a control shaft is arranged parallel to the drive shaft which is connected over a transmission with an integral reduction ratio to the drive shaft and likewise carries a second double cam plate, which sets a second two-arm lever, which can be detachably connected with the coupling rod into a swivel movement. Due to the integral reduction ratio of this control shaft, the second two-arm lever is set into a swivel movement only at every second, third or multiple carriage stroke, depending on the reduction ratio, so that the round stock feed through the feeding device only takes place at every second, third or multiple carriage stroke. It is of advantage that the press carriage does not work with single strokes, as in forging presses, but performs idle strokes, since the single-stroke method results in great stress on the clutch and brake.

According to another feature of the invention, the coupling rod is connected to an adjusting device for adjusting the feed length. Such an adjusting device is particularly necessary when different molded parts have to be produced on a machine.

Furthermore it is suggested that the conveyor device consists of a swivel gripper controlled over a swiveling device for transporting the cut-off round stock from the shearing station to the die. The swivel gripper can be locked according to another feature of the invention, in a swivel position relative to the die. Locking the swivel gripper in this position is of particular advantage if sections of the round stock fed into the reshaping press are unsuitable for reshaping. These sections then drop out of the reshaping press from the shearing station over a chute, if necessary, without being conveyed to the die. Such a possibility for sorting out unsuitable sections is of particular advantage when working according to the half-warm method, since the probability that unsuitable material will be drawn-in is much greater than in cold pressing.

In a further development, the swiveling device consists of a swivel gripper controlled over a swiveling device for transporting the cut-off round stock from the shearing station to the die. The swivel gripper can be locked according to another feature of the invention, in a swivel position relative to the die. Locking the swivel gripper in this position is of particular advantage if sections of the round stock fed into the reshaping press are unsuitable for reshaping. These sections then drop out of the reshaping press from the shearing station over a chute, if necessary, without being conveyed to the die. Such a possibility for sorting out unsuitable sections is of particular advantage when working according to the half warm method, since the probability that unsuitable material will be drawn-in is much greater than in cold pressing.

In a further development, the swiveling device consists of a cam disc whose track is force-locked with a tipping lever pressed on over a controllable pneumatic spring and can be lifted from the track by controlling the pneumatic spring.

Furthermore it is suggested according to the invention to provide the die with a combined heating and cooling device. This heating and cooling device can have a die temperature regulating device according to another feature of the invention. In order to keep the heat transfer from the die to the machine frame of the reshaping press low, the die is surrounded with cooling plates. These cooling plates can be so designed that they can be admitted with a cooling medium.

In order to keep the thermal stress of the pressing tools low, particularly when working according to the half-warm pressing method according to the invention and in order to reduce the friction between tool and workpiece, the reshaping press can have according to another feature of the invention a combined high-pressure spray and fluid lubrication unit for lubricating the workpiece and for spraying a cooling and lubricating emulsion on the pressing tools and workpieces.

Finally it is suggested according to the invention to provide the driving device with a return mechanism. This way the round stock drawn into the reshaping press can be removed from the latter when the machine has to be stopped for some reason. The temperature of the round stock can be kept constant in the inductance heater only when it passes through the machine, but not when the machine is stopped.

The invention is illustrated in the drawings on the basis of an embodiment.

Figure 1:
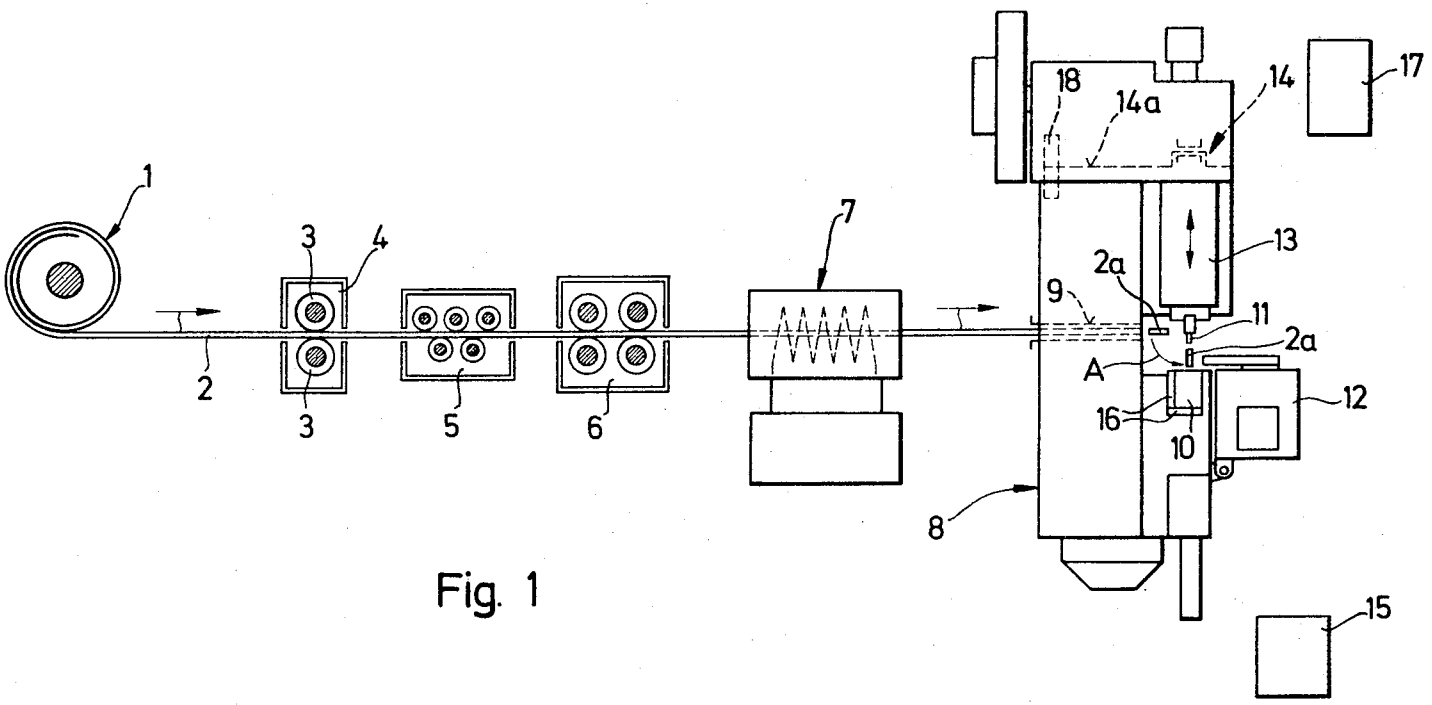
FIG. 1 shows a schematic general view of the machine according to the invention.

FIG. 1 shows a schematic repesentation of an arrangement for carrying out the method according to the invention. The arrangement is so designed that a wire 2 wound on a reel 1 can be used as a starting material to be pressed, which is brought from the reel 1 by hand between the feed rollers 3 of a driving device 4 when the machine is started. This driving device 4 serving as an auxiliary device transports the wire 2 into a straightening device 5 where the wire 2 is straightened and from there between the feed rollers of a feeding device 6. This feeding device 6 takes over the further transportation, while the driving device 4 is disconnected. The wire 2 is now conveyed intermittently through the feeding device 6 and passes through an inductance heater 7 where it is heated to a temperature in the half-warm range, namely between 600° and 850° C. During the passage through the inductance heater 7 the temperature of the wire 2 is kept constant by means of a temperature regulating device at a given temperature. But if the wire 2 does not move in the inductance heater when the press is stopped, a temperature regulation is no longer possible. For this case the driving device 4 has a return mechanism (not shown here) with which the wire 2 can be withdrawn from the press after the feeding device 6 has been disconnected.

The wire 2 arrives then in the heated state from the rear in the reshaping press 8 and passes there through a holding furance 9 which keeps the temperature of the wire 2 in the half-warm range. The wire 2 then strikes in the shearing station (not shown here, see FIG. 4) against a stop and is then cut off by a shearing blade and pushed into a swivel gripper which turns the wire piece 2*a* by 90° in the direction of arrow A where it arrives in the die 10. Then the wire piece 2*a* is reshaped over the press ram 11 and is brought into the other reshaping stages over a conveyer device 12.

As indicated previously, the wire stock which is useful in the present invention is a steel such as eutectoid steel. The $Ac_1$ transformation point of eutectoid steel is about 720° C., making it particularly useful in the present invention. Other steels suitable for use are those which also have the transformation point within the range of 600° C. to 850° C.

The press ram 11 is secured on the press carriage 13 which is moved back and forth over a crank drive 14 (broken line). The die 10 is provided with a combined heating and cooling device which is regulated over a die temperature regulating device 15 and which keeps this way the tools at the end of the die at a temperature of about 150° C. This way the temperature difference between the wire piece 2*a* to be pressed and the die, and thus the heat transfer is reduced, so that the wire piece 2*a* does not cool off so rapidly and, on the other hand, tension cracks and thus premature rupture of the tools at the end of the die are avoided. This is of particular advantage when the machine is started, when the tools are still relatively cold, and their operating temperature is only slowly established. Particularly then the accuracy-to-measure of the parts is improved by preheating. For rapid cooling of the tools before they are replaced, the die temperature regulating device can be switched to cooling only. In order to keep the heat transfer from the die to the machine frame of the reshaping press 8 as low as possible, the die 10 is surrounded by cooling plates 16 connected to a cooling water unit.

In order to reduce the thermal stress on the tools further, a combination high-pressure spray and fluid lubrication unit 17 is provided which sprays a cooling emulsion on the tools, which has in addition to the cooling also a lubricating effect to reduce the wear of the tools.

Figure 2:
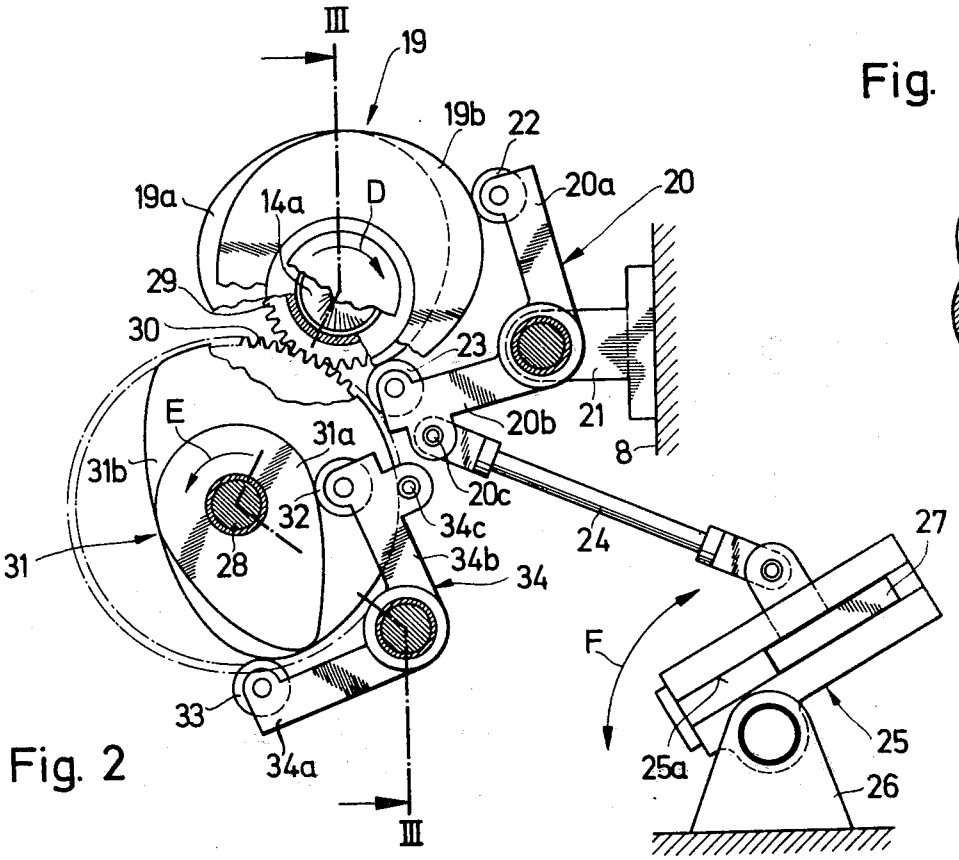
FIG. 2 shows the feeding control device in an elevation.

On the left end (in this view) of the drive shaft 14*a* for the crank drive 14 is arranged a feeding control device 18 which is connected with the feeding device 6. This feeding control device 18 is represented in its essential parts in FIG. 2 and 3. FIG. 2 shows in an axial view the drive shaft 14*a* for the crank drive 14 (see FIG. 1) which turns in the direction of arrow D. The drive shaft 14*a* carries a double cam plate 19 which consists of two interconnected cam plates 19*a* and 19*b* arranged in series. The cam plates 19*a* and 19*b* are so shaped that they set a two-arm lever 20 into a periodically reciprocating movement. This two-arm lever 20 designed as angle lever is rotatably mounted on a bearing block 21 which in turn is secured on the machine frame of the reshaping press 8. It has at each end of its lever arms 20*a* and 20*b* a tap roller 22 and 23, one tap roller, in this representation the upper roller 22 running on the front track of the front cam plate 19*b* and the other, the lower tap roller 23, running on the front track of the rear cam plate 19*a*.

The lower lever arm 20*b* of the two-arm lever 20 has at its end a fulcrum 20*c* on which a coupling rod 24 is detachably mounted with one end, which in turn is secured on an adjusting device 25 for adjusting the feed length. This adjusting device 25 is likewise rotatably mounted in the direction of the double arrow F on another bearing block 26. In a groove 25*a* of the adjusting device 25 is mounted a slider 27 which can be locked in this groove 25*a* in any position. The swivel path transmitted by the coupling rod 24 increases the more this slider 27 is displaced to the right in this representation.

On this slider 27 is secured the linkage for the feeding device (6) (not shown here), so that the wire 2 is advanced with each reciprocal movement of the two-arm lever 20, of the coupling rod 24, and of the adjusting device 25 by a certain length in the feeding device 6, namely the feed length, this path length being the greater the more the slider 27 is displaced to the right in the adjusting device 25.

The double cam plate 19 is so shaped that the two-arm lever 20 performs a reciprocal movement per revolution of the drive shaft 14*a*. This way a wire section is fed to the die 10 with each stroke of the press carriage. In order to keep the high thermal stress of the pressing tools low in half-warm pressing, the feeding control device 18 is so designed that a wire piece 2*a* is fed to the die 10 only with every second, third or multiple stroke of the press carriage. This way the cooling time is relatively long, compared to the time in which the hot wire piece 2*a* is in contact with the die 10, so that the tools can cool off in the meantime before a new wire piece 2*a* is introduced.

The feeding control device 18 has to this end a control shaft 28 which is mounted parallel to the drive shaft 14*a* and which is driven by the latter over a gearing with a gear wheel 29 and 30 (symbolized by the dash-dotted line of the divided circles in the direction of arrow E, the reduction ratio being always an integral number. In the present representation the speed ratio drive shaft 14*a* to control shaft is 1:2.

The control shaft 28 carries a second double cam plate 31 consisting of the front cam plate 31*a* and of the rear cam plate 31*b*. On the front running surfaces of these cam plates 31*a* and 31*b* run the tap rollers 32 and 33, which are mounted on the ends of the lever arms 34*a* and 34*b* of another two-arm lever 34 which is set this way likewise into a reciprocating movement. At the end of the upper lever arm 34*b* (in this view) of the two-arm lever 34 is provided likewise a fulcrum 34*a*. On this fulcrum 34 can be secured the coupling rod 24 over an easily detachable bolt connection. This way a reciprocal movement of the two-arm lever 34, of the coupling rod 24, and of the adjusting device 25 takes place only after every second stroke of the press carriage, this movement being transmitted to the feeding device 6. Consequently the wire 2 is likewise only advanced by one feed length with every second carriage stroke.

Figure 3:
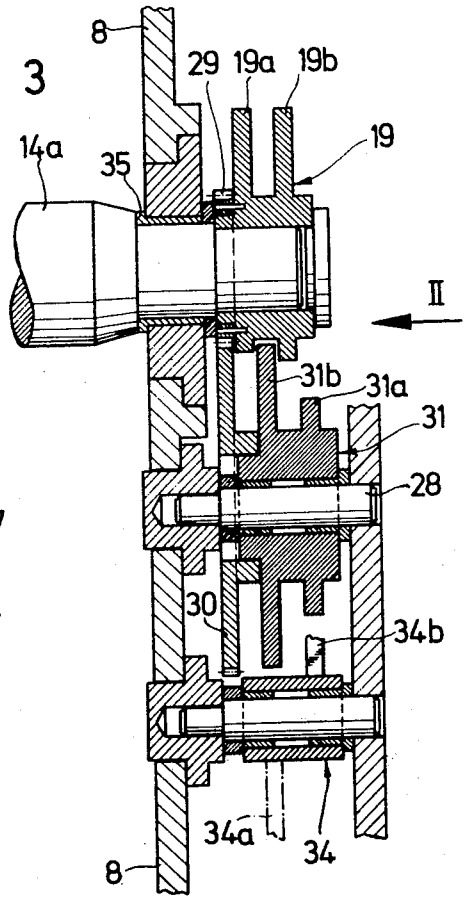
FIG. 3 shows the feeding control device according to FIG. 2 in a section III—III.

FIG. 3 shows the feeding control device 18 in a section along the lines III—III of FIG. 2 with the drive shaft 14*a* which is mounted on the machine frame of the reshaping press 8 over a bush 35 and which carries at its end the overhung double cam plate 19 with the cam plate 19*a* and 19*b*. Below the drive shaft 14*a* is arranged the double-mounted shaft 28 which carries the second double cam plate 31 with the cam plates 31*a* and 31*b*. Both shafts 14*a* and 28 are connected with each other over the two gear wheels 29 and 30. Below the control shaft 28 can be seen the bearing of the second two-arm lever 34.

Figure 4:
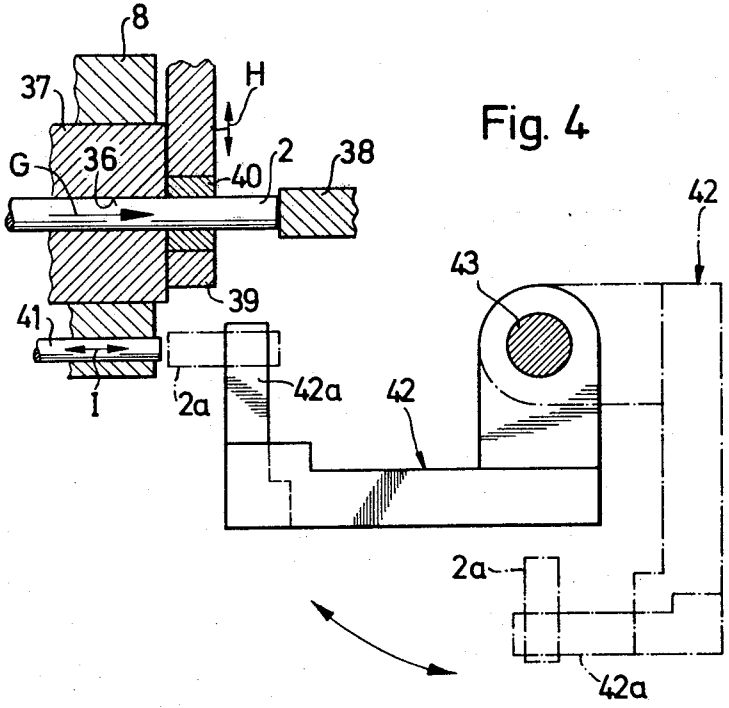
FIG. 4 shows a partial section through the shearing station with the conveyer device.

FIG. 4 shows in a detail of the reshaping press 8 the shearing station of the arrangement according to the invention, in which the wire 2 is cut to length. To this end the wire 2 passes through the machine frame of the reshaping press 8 in the direction of arrow G, as shown in FIG. 1, and then through a duct 36 in a replaceable shearing block 37 corresponding to the diameter of the wire 2, until it strikes against the adjustable stop 38. It passes through the shearing bush 40 inserted in the shearing blade 39, whose opening diameter corresponds likewise to the outside diameter of the wire 2. This shearing blade 39 moves then in the direction of the double arrow H and cuts off this way the wire piece 2*a* projecting over the edge of the shearing block 37. The shearing blade 39 moves then with the wire piece 2*a* held in bush 40 so far until the latter is at the level of an ejector pin 41 (broken line) moving back and forth in the direction of arrow I. The ejector pin 41 then ejects the wire piece 2*a* out of the shearing bush 40 into the gripper arm 42*a* of a swivel gripper 42 mounted on the pivot 43. This swivel gripper 42 then swivels from the position indicated by solid lines by 90° into the position indicated by broken lines, in which the wire piece 2*a* drops into the die 10, not shown here (see FIG. 1).

Particularly in half-warm molding it can happen that wire pieces 2*a* unsuitable for reshaping get into the shearing station. To this end the swivel gripper 42 is provided with a swiveling device which can be so connected that the swivel gripper 42 no longer conveys the unsuitable wire pieces 2*a* to the die 10.

Figure 5:
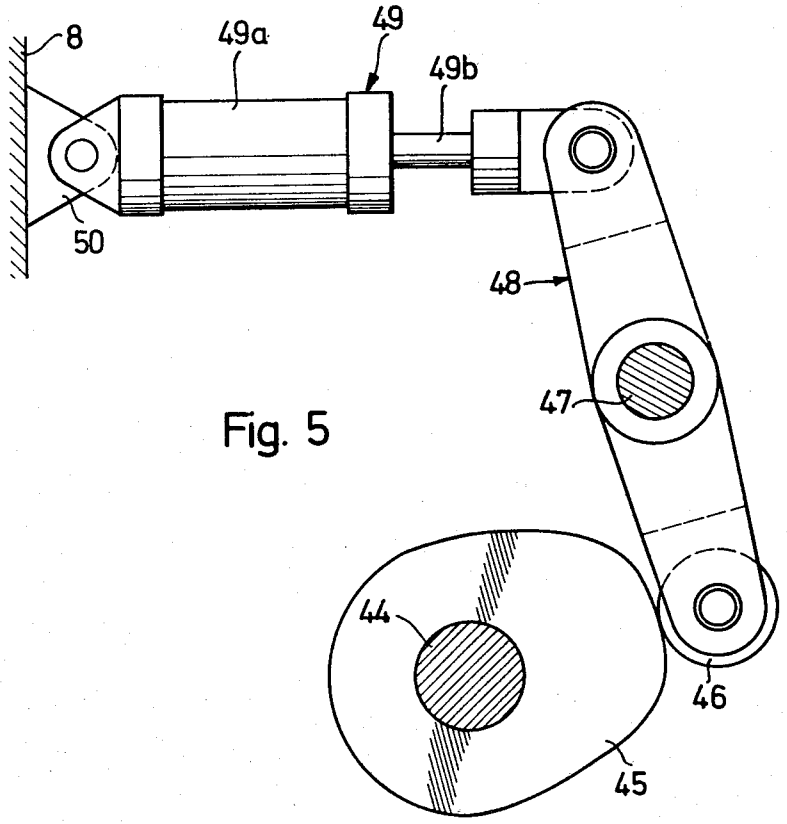
FIG. 5 shows an elevation of the swiveling device.

This swiveling device is represented in FIG. 5 in its principal structure. A camshaft 44 running in synchronism with the drive shaft 14*a* of the crank drive 14 or of the press carriage carries a cam disk 45 on the front running surface of which runs a roller 46 which is secured on the end of a tipping lever 48 mounted on a pivot 47. At the other end of the tipping lever 48 is articulated the piston rod 49*b* of a pneumatic spring 49 consisting of a cylinder 49*a* and of a piston guided in this cylinder 49*a*. The cylinder 49*a* of the pneumatic spring 49 is articulated at its closed end to a bearing block 50 on the machine frame of the reshaping process 8. By means of this pneumatic spring 49 the tipping lever 48 is pressed in the normal case against the running surface of the cam disk 45 and performs a reciprocating movement per revolution of the cam shaft 44, due to its shape. This movement is transmitted over a form-clocked linkage (not shown here) from the tipping lever 48 to the pivot 43 of the swivel gripper 42.

But if unsuitable wire piece 2*a* are to be sorted out from the reshaping press 8, the piston in cylinder 49*a* is admitted with so much overpressure that the piston rod 49*b* is retracted into the cylinder 49*a* so that the tipping lever 48 is lifted slightly from the track. In this position of the tipping lever 48 the swivel gripper 42 is in the position represented in broken lines in FIG. 4, so that the wire piece 2*a* ejected by the ejector pin 41 from the shearing blade 39 cannot get into the gripper arm 42*a* but drops out of the reshaping press 8 over a chute, not shown here. By corresponding reversal of the air pressure, the pneumatic spring 49 can again work so, if necessary, that it presses the tipping lever 48 on the cam disk 45 agains so that the swivel gripper 42 performs again its swiveling motions and conveys this way the wire pieces 2*a* into the die 10.

While this invention has been described as having a preferred design, it will be understood that it is capable of further modification. This application, is therefore, intended to cover any variations, uses, or adaptations of the invention following the general principles thereof and including such departures from the present disclosure as come within known or customary practice in the art to which this invention pertains, and as may be applied to the essential features hereinbefore set forth and fall within the scope of this invention or the limits of the claims.

What is claimed is:

1. An apparatus for producing pressed parts to close tolerance from eutectic steel wire stock wound on a supply reel comprising:

means for drawing said wire stock from said supply reel followed by means for straightening said wire stock, a press having a holding furnace, a shear station and pressing dies, a wire stock heating furnace for heating said wire stock to a temperature above the cold forging temperature range and below the hot forging temperature range and with the semi-warm range of 600°-850° C., a wire stock feed mechanism consisting of two pairs of longitudinally spaced feed rollers disposed upline from said heating furnace for firmly gripping and intermittently pushing said wire stock while unheated through said heating furnace and into said holding furnace for maintaining the temperature of said wire stock within said semi-warm without handling of the heated wire stock, means for maintaining the temperature of said pressing dies at at least about 150° C. for minimizing die wear and thermal differential with said wire stock, and transfer means for transferring cut pieces of wire from said shear station to said pressing dies.

2. Apparatus as in claim 1, wherein said transfer means includes an arm having a holder to receive the cut piece of wire stock from the shear, said arm being pivoted so that said holder and the piece of stock carried thereby is swung to a position in register with said die, so that the piece of wire stock can be ejected from the holder into the die for the forming operation.

3. Apparatus as in claim 2, wherein means is provided to hold said arm in a position where it is incapable of receiving a cut piece of wire stock from the shear, so that the piece of wire stock is discarded.

4. A method for producing pressed parts from eutectic steel wire stock wherein the wire stock is drawn from supply reels and subjected to shaping in a press, the method comprising:

drawing the wire stock from a supply reel through a straightening device by means of a feed mechanism, operating said feed mechanism so as to push said wire stock intermittently into and through a heating furnace located downline from said feed mechanism to a shaping press having shaping dies, heating said wire stock to a temperature above the cold forging temperature and below the hot forging temperature and within the semi-warm range of 600°-850° C. in said heating furnace and maintaining the temperature of said wire stock in said range during transit from the heating furnace to said press by means of a holding furnace, maintaining said dies of said press at a temperature of at least 150° C., and subjecting said heated wire stock successively severing, positioning and pressing operations in said press for producing said parts.

* * * * *